US005240352A

United States Patent [19]

Ilomäki

[11] Patent Number: 5,240,352

[45] Date of Patent: Aug. 31, 1993

[54] METHOD FOR THE MOUNTING OF UNDERGROUND PIPELINES

[76] Inventor: Valto Ilomäki, Loilantie 8, SF-33470 Ylöjärvi, Finland

[21] Appl. No.: 848,988

[22] PCT Filed: Oct. 25, 1990

[86] PCT No.: PCT/FI90/00252

§ 371 Date: Apr. 20, 1992

§ 102(e) Date: Apr. 20, 1992

[87] PCT Pub. No.: WO91/06798

PCT Pub. Date: May 16, 1991

[30] Foreign Application Priority Data

Oct. 25, 1989 [FI] Finland ..... 895057
Apr. 3, 1990 [FI] Finland ..... 901670

[51] Int. Cl.[5] ..... E02F 5/18; F16L 1/00

[52] U.S. Cl. ..... 405/184; 405/174; 175/62

[58] Field of Search ..... 405/154, 174, 177, 184; 254/29 R; 175/53, 62

[56] References Cited

U.S. PATENT DOCUMENTS

| | | | |
|---|---|---|---|
| 2,074,003 | 3/1937 | Templeton et al. | 405/184 X |
| 2,325,565 | 7/1943 | Williams | 405/184 |
| 3,656,563 | 4/1972 | Blinne | 175/62 X |
| 4,124,082 | 11/1978 | Garver | 405/184 X |
| 4,146,347 | 3/1979 | Woods | 175/621 X |
| 4,650,374 | 3/1987 | Schmidt | 405/184 |
| 4,671,703 | 6/1987 | Schmidt | 405/184 |
| 5,110,237 | 5/1992 | Hesse | 405/184 |

FOREIGN PATENT DOCUMENTS

| | | | |
|---|---|---|---|
| 1811421 | 6/1970 | Fed. Rep. of Germany . | |
| 2343079 | 4/1974 | Fed. Rep. of Germany . | |
| 51726 | 11/1976 | Finland . | |
| 223281 | 10/1968 | Sweden . | |
| 411641 | 1/1980 | Sweden . | |
| 426869 | 2/1983 | Sweden . | |
| 446472 | 9/1986 | Sweden . | |
| 1041646 | 9/1983 | U.S.S.R. | 405/184 |

*Primary Examiner*—Dennis L. Taylor
*Assistant Examiner*—Arlen L. Olsen
*Attorney, Agent, or Firm*—Larson and Taylor

[57] ABSTRACT

A method for mounting pipelines (8) or outer walls of a tunnel in the ground where one after another joined polygon or round cylinders are forced to penetrate into the ground when the soil cut by the front edge of the first cylinder (2) moves into the said cylinders during tunnelling. The cylinders (2, 3, 4, 15) containing soil are replaced by the final pipe/piping (8) meant for the ground, by forcing and/or pulling said pipe/piping in the place of said cylinders and the soil excavated from the tunnel is removed from the tunnel inside the said cylinders when said cylinders are forced out of the tunnel.

8 Claims, 2 Drawing Sheets

METHOD FOR THE MOUNTING OF UNDERGROUND PIPELINES

FIELD OF THE INVENTION

The invention relates to a method wherein pipes are mounted into ground by pushing them successively into the ground. Before the ground forced excavating cylinders are replaced by the final corresponding pipes, which are pulled or pushed into the tunnel, the soil inside the first excavating cylinders is removed from the tunnel along with the excavating cylinders. The invention is suitable for mounting pipes especially into stoneless fine-grained soil, such as for leading pipelines under roads.

BACKGROUND OF THE INVENTION

When pipe diameters are small and distances short, it is possible to use soil-displacing methods in which the pipe is thrust into the desired direction by applying a sufficient force. A shaped head mounted at the end of the pipe displaces as much soil as is required by the cross section of the pipe. Such a device was presented in publications DE-1811421 and FI 51726. According to these methods the soil is forced to pack sideways and later soil is packed more when enlarging the hole or when soil is removed through the hole. The hole can be enlarged if it remains open without collapsing.

Swedish publication 446472 discloses a method of forcing cylindrical parts into ground by adding extra parts successively in starting excavation. The cylindrical parts are filled by soil which is removed by some known methods when the cylinders are in the built tunnel.

Methods which need an arbor to make the hole or to enlarge the hole have a disadvantage that holes can easily collapse. For this method is advantageous that the arbor pull a cable when, for example, it is forced under the road.

In the method according to Swedish publication 446 472 the diameter of pipe is so large (2 m) that the pipe must be emptied of soil by soil transporting apparatus. A pipe with a large diameter cannot be pushed under roads or railways without road damaging movements and displacements.

SUMMARY OF THE INVENTION

The invented method offers a fundamental improvement over the above-mentioned shortcomings. The invented method is characterized in the following patent claims.

The most important advantages of the invention are that during hole tunneling, the collapsing of the road is prevented. When the cylinders are forced into ground by quick impacts of a hammer, the soil of road is not displaced. Extra soil or ground material outside the tunnel cannot be removed, only that soil which is placed inside the cross sectional area of the tunnel can be removed. That is why subsidences or depressions above the tunnel are not observable afterwards.

BRIEF DESCRIPTION OF THE INVENTION

In the following there is a detailed description of the invention with references to the enclosed drawings.

DETAILED DESCRIPTION OF THE PREFERRED EMBODIMENTS

Figure 1:
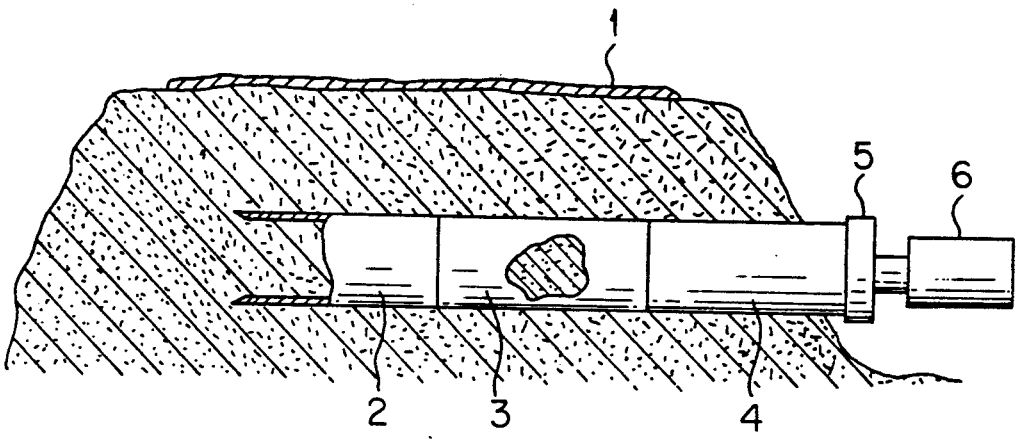
FIG. 1 represents excavating cylinders forced under a road.

In FIG. 1 the invention is applied for tunnelling under a road 1. The cylinders 2, 3, 4 are forced to penetrate under the road by hammer 6. The impacts are directed to the rear-most cylinder and a flange 5 transmits the impacts. The first cylinder is comprised of an abrasion resistant material, at least at the front end, and sharpened. Because of quick impacts, the soil is not able to move in spite of penetrating of the cylinders.

Figure 2:
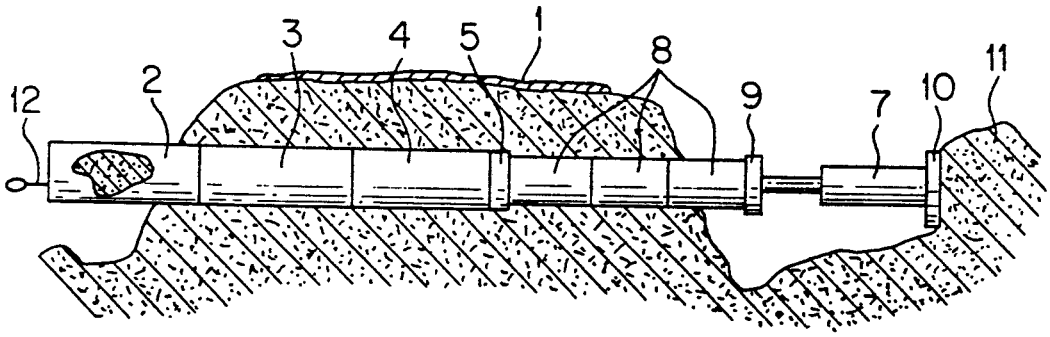
FIG. 2 represents pushing of final pipes to replace excavating cylinders.

FIG. 2 shows pushing of outer pipes 8 of the tunnel. The pushing occurs by constant force of hydraulic cylinder 7. The cylinder is supported by a wall 11 of soil with supporting plate 10. The outer pipes 8 are pushed by means of a flange 9, which is leading the pushing force always to the rearmost cylinder. A cable 12 has been fixed to the first cylinder 2 and said cable has been led under the road simultaneously. Inside the cylinders 2,3,4 the excavating soil is removing from the tunnel when the cylinders are replaced by piping 8.

Figure 3:
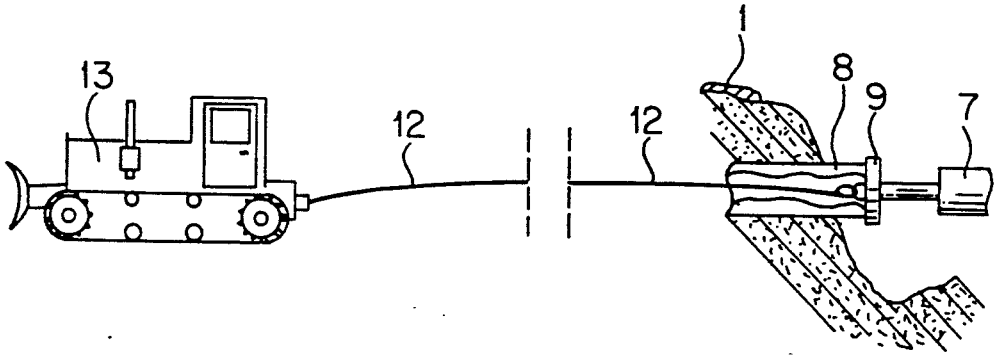
FIG. 3 represents a pulling of final pipes under a road.

FIG. 3 shows the pushing of outer pipes 8 by hydraulic cylinder 7 and simultaneously pulling by means of caterpillar 13. Inside the pipings cable 12 is fixed to flange 9 and the opposite end of the cable, which comes out of the first cylinder 2, is fixed to the caterpillar so that the caterpillar can pull the whole piping. The pulling can be carried out only by means of a pulling machine, but it is very advantageous that the pulling is helped by hammering or pushing, or by all presented methods, simultaneously.

Figure 4:
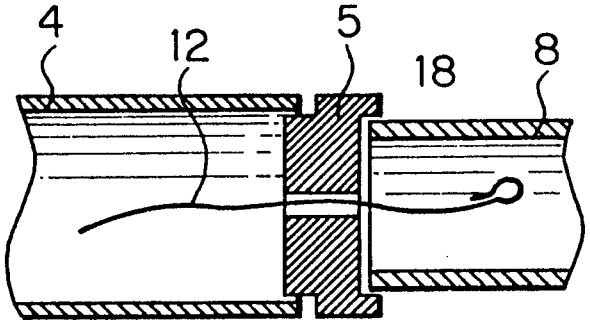
FIG. 4 represents a flange between pipings.

FIG. 4 shows a flange 5 placed between pipings 4 and 8. The flange has shoulders for cylinders 4 as well as for piping 8. The flange has a center hole 18 for the cable. The flange prevents the excavated soil from moving into the final pipes 8 and ensures that said soil is removed from the tunnel inside the excavating pipes. The method is very useful when the diameter of final piping 8 is approximately the same as the diameter of excavating pipes.

Figure 5:
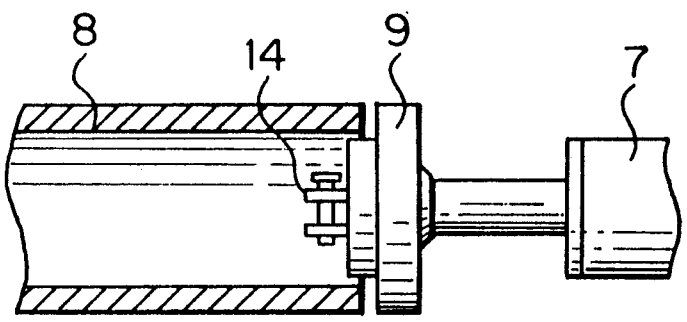
FIG. 5 represents a pulling/pushing part of final piping.

FIG. 5 shows a flange 9 of the rearmost final pipe 8. The flange is equipped with a fixing means 14 for a puller, such as the cable 12. The flange has a shoulder for repeated mounting in the end of successive pipes.

Figure 6:
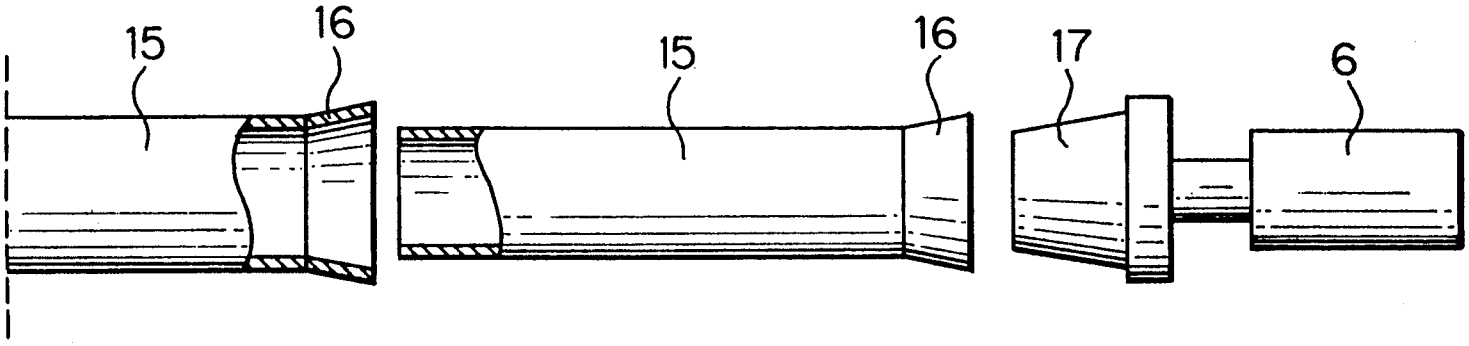
FIG. 6 represents a conical joint of excavating cylinders.

FIG. 6 shows how a conical end shape 16 is formed by hammer tool 17 in the end of cylinders 15. The hammer 6 is equipped with a conical tool 17 which transmits impacts to the cylinder 15. The conical tool 17 penetrates immediately into the cylinder when hammering begins and forges cone-shaped end 16 for the cylinder. At a certain moment after hammering, the cone-forging ends and cylinders 15 begin to penetrate into the ground when hammering continues. In this way the space between cylinders becomes very tight and excellently transmits impacts and force to the joint. The cylinders as well as the tool part 17 are loosened most easily by deviating them in a sidewards or a vertical direction and simultaneously pulling the cone joint open. The front edges of cylinders 15 contract in some degree when they are forced inside the previous cylinders.

The loosening and emptying of the cylinders 15 when they are pushed out from the tunnel, can be effected by high frequency vibrations or impacts. The easiest loosening method is to deviate the loosened cylinder from the direction of the previous cylinder when the cone joint loosens. Also is possible to flatten the cone joint 16 when it loosens.

The invention has been explained with reference to only a few of the preferred embodiments. The invention, however, is in no way restricted to the above examples. Modifications ca be performed within the limits of the invented idea as defined in the following patent claims.

I claim:

1. A method of mounting pipelines or tunnels in the ground comprising the steps of:

(a) forcing successively joined polygonal or round conduit sections each having front and rear ends, into the ground so as to penetrate the soil;

(b) cutting and moving the soil cut by a front edge of a first conduit section into the conduit sections;

(c) replacing the conduit sections with final pipe/piping by pushing and/or pulling said pipe/piping in place of the conduit sections; and (d) removing the conduit sections and the soil therein from the ground so as to remove the excavated soil.

2. The method of claim 1 wherein conical lap joints are used to join the polygonal or round conduit sections.

3. The method of claim 2 further comprising the steps of removing soil from said conduit sections and to loosen the conical lap joints between said conduit sections using high frequency impacts or vibration after said step of removing the conduit sections.

4. The method of claim 1 further comprising forming the rear ends of said conduit sections into a conical shape by impacts from a conical tool during said step of forming.

5. The method of claim 1 wherein the pulling is effected by a pulling apparatus, said pulling apparatus having a cable attached thereto, an opposite end of said cable being attached to a pulling/pushing flange at a rear end of a rearmost conduit section.

6. The method of claim 5 wherein said flange prevents soil from moving from said conduit sections to said final pipe/piping, said flange being equipped with a hole for inserting said cable through said flange for attachment to said pipe/piping.

7. The method of claim 1 wherein said pushing is effected by a hammering tool.

8. The method of claim 1 wherein said final pipe/piping is of approximately the same outer diameter as said conduit sections.

* * * * *